United States Patent [19]

Bardsley et al.

[11] 4,399,158

[45] Aug. 16, 1983

[54] PRESSURIZED CONTAINER PROVIDING FOR THE SEPARATE STORAGE OF A PLURALITY OF MATERIALS

[75] Inventors: Robert F. Bardsley, Harrington Park, N.J.; Thomas P. Finucane, Hartsdale, N.Y.; Carl Hebel, Dover Foxcroft, Me.; Charles D. Schoonmaker, Boonton Township, Morris County, N.J.; Philip J. Wruk, Wilton, Conn.; Edward P. Lee, deceased, late of White Plains, N.Y., by Janice N. Lee, executrix

[73] Assignee: General Foods Corporation, White Plains, N.Y.

[21] Appl. No.: 336,838

[22] Filed: Jan. 4, 1982

Related U.S. Application Data

[63] Continuation of Ser. No. 917,262, Jun. 20, 1978, abandoned.

[51] Int. Cl.[3] ..... B65D 25/08

[52] U.S. Cl. ..... 426/112; 206/219; 206/217; 426/115; 426/86; 426/120; 426/124; 222/145

[58] Field of Search ..... 426/115, 86, 116, 124, 426/120, 131, 112; 206/222, 219, 217, 218, 221; 141/3, 20

[56] References Cited

U.S. PATENT DOCUMENTS

| | | | |
|---|---|---|---|
| 2,660,171 | 11/1953 | Dickinson | 206/221 |
| 2,671,424 | 3/1954 | Herring et al. | 206/219 |
| 2,687,130 | 8/1954 | Cohen | 206/222 |
| 2,753,990 | 7/1956 | Chalfin | 206/221 |
| 2,900,100 | 8/1959 | Debat et al. | 206/222 |
| 3,386,837 | 6/1968 | Arnot | 206/0.5 |
| 3,410,444 | 11/1968 | Morane | 206/221 |
| 3,513,886 | 5/1970 | Easter et al. | 426/115 |
| 3,630,415 | 12/1971 | Morane et al. | 141/20 |
| 3,635,261 | 1/1972 | Morane et al. | 141/3 |

*Primary Examiner*—Steven L. Weinstein

*Attorney, Agent, or Firm*—Daniel J. Donovan; Thomas R. Savoie

[57] ABSTRACT

A container providing for the storage of a pressurized fluid, such as a carbonated beverage, and having a separate compartment therein for the segregated storage of a second material, such as a flavoring for the beverage. The arrangement is responsive to a rapid drop in pressure which occurs in the container upon opening thereof to automatically cause the release of the second material from the compartment and dispensing thereof into the fluid stored in the container.

3 Claims, 17 Drawing Figures

PRESSURIZED CONTAINER PROVIDING FOR THE SEPARATE STORAGE OF A PLURALITY OF MATERIALS

This is a continuation, of application Ser. No. 917,262, filed June 20, 1978, now abandoned.

BACKGROUND OF THE INVENTION

1. Field of the Invention

The present invention relates, in general, to pressurized containers and, more particularly, pertains to pressurized containers having facilities for the separate storage of several different ingredients of a product until it is desired to admix them, at which time it is possible to establish communication between the ingredients for admixing thereof prior to being dispensed from the containers.

Pressurized containers of this type are useful for the separate storage of ingredients or materials for a variety of products, and have particular applicability to products in the fields of pharmaceuticals and cosmetics, for instance, where at least two ingredients can be stored separately for reasonably lengthy periods of time, but if admixed will produce a product which deteriorates rather rapidly. Such products usually, but not necessarily, comprise at least one liquid component and one other ingredient which may be either in the form of a liquid component or in the form of dry granules or powder.

Another important field of application for containers of this type lies in the packaging of food products and, particularly, the storage of beverages. At least one new flavoring for carbonated beverages is being investigated which has significant potential consumer appeal in comparison with existing products. However, the beverage has a limited shelf life after the flavoring, which is in the form of a dry powderous or granular material, is mixed with carbonated water, inasmuch as the admixture of the two ingredients deteriorates fairly rapidly because of a hydrolysis reaction which takes place between them. The flavoring has a much longer shelf life when it is stored in a dry condition and separated from the water-based liquid. The product is inherently more flavorful and marketable when packaged in a container which maintains the flavoring and carbonated water in separate compartments and inaccessible to each other up to the point in time at which the container is opened for the purpose of dispensing the beverage.

2. Discussion of the Prior Art

At present, the prior art discloses several different types of containers or receptacles which are designed to separately store the ingredients or materials of a product prior to the opening of the containers.

Nosik U.S. Pat. No. 2,721,522; Bowes et al. U.S. Pat. No. 3,156,369; Magni U.S. Pat. No. 3,603,469; and Lanfranconi et al. U.S. Pat. No. 3,840,136 each disclose multi-compartmented containers for the separate storage of various ingredients or materials of a product which are adapted to be admixed prior to dispensing from the containers. Each of these patents discloses a type of container in the shape of a bottle, can or the like wherein a frangible member is adapted to be severed or ruptured by the depression of a plunger so as to dispense a material stored within the neck of the bottle into a liquid which is located in the container. However, severance of the frangible member is caused by a relatively complex mechanism usually requiring the depression of a plunger which causes the frangible member to rupture or sever. Admixing of the separate ingredients in these prior art arrangements is not accomplished automatically in response to changes in pressure within the container. Moreover, in various of these earlier patents, loose debris is released into the container upon admixing of the materials therein and prior to dispensing of the product, which will render the containers unattractive from a consumer standpoint.

Winsten U.S. Pat. No. 2,562,401 and Cohen U.S. Pat. No. 2,687,130 each discloses containers having facilities for the separate storage of two ingredients wherein one of the ingredients is stored within a pressure-responsive capsule located in a liquid in the container. The container is flexible, and may be manually squeezed to increased the pressure therein so as to cause the capsule to rupture and resultingly cause the release of its contents into the liquid in the container. These known prior art designs are quite distinct from the present invention in that each requires the container to be squeezed to cause the release of the contents of the capsule into the liquid in the container. Neither of these prior designs is responsive to a pressure change taking place within the container which occurs upon opening thereof to automatically cause the admixing of the separately stored materials or ingredients.

Chalfin et al. U.S. Pat. No. 2,753,990 disclose a glass bottle having large and small-sized separate compartments for the segregated storage of first and second liquids in the separate compartments. Opening of the large compartment causes its pressure to be released so as to cause its pressure to drop to a level lower than that of the smaller compartment. A valve is located in a common glass wall separating the compartments and the resultant pressure differential generated between the two compartments causes the valve to open, thereby allowing admixing of the first and second liquids. Chalfin et al. require the provision of a rather elaborate glass container having separate large and small glass compartments with an aperture formed in a common wall separating the two compartments. Further, a pressure-responsive valve is required to be positioned in the aperture in the common wall. This construction is relatively complex and results in it being costly and uneconomical from a commercial standpoint. Addition ally, this prior art design has the drawback in that each of the compartments must be pressurized separately.

SUMMARY OF THE INVENTION

Accordingly, the present invention contemplates the provision of an improved and unique container having an arrangement for separately storing several materials or ingredients of a product within a container prior to opening of the container and which, upon opening of the container, provides for the automatic and practically instantaneous admixing of the separately stored materials prior to being dispensed therefrom.

In accordance with a preferred embodiment of the invention, there is disclosed an arrangement for separately storing at least first and second materials within a container and providing for the automatic admixing of the materials upon opening of the container. The first material is stored within the container at a pressure other than the ambient pressure surrounding the container. The second material is stored within a separate compartment in the container which has a separable wall to allow release of the second material therefrom. The arrangement incorporates pressure-responsive structure which is responsive to a rapid change in pressure within the container occurring upon opening thereof, to automatically cause the separable wall of the compartment to open and thereby allow for the admixing of the first and second materials. Further in accordance with the teachings of the present invention, the compartment has a maximum of one wall formed by a portion of the container, and several embodiments have no walls formed by or in contact with the container.

In several disclosed embodiments of the invention, the first material is stored in the container at superatmospheric pressure and the externally reigning ambient pressure is atmospheric pressure. These embodiments are responsive to the rapid drop in pressure which occurs within the container upon opening thereof. Moreover, in various embodiments of the invention, the separable wall is constituted by a frangible wall of the compartment, whereas in other embodiments the compartment is defined by separable components with the separable wall being formed by the wall along which the components are joined together.

Additionally, in one disclosed embodiment of the invention, an adhesive material which is soluble in the liquid in the container is utilized to initially releasably glue the compartment components together. In effect, the arrangement is such whereby the compartment is filled with the second material, and the components are fastened together with the soluble adhesive. The compartment is then placed in the liquid in the container where the adhesive will gradually dissolve, leaving only the pressure differential between the interior of the compartment and the interior of the container about the compartment to hold the separable components together.

Furthermore, in several embodiments of the invention, the separate compartment has an exterior wall formed of a material which is permeable to the gas pressurizing the container so that the pressure in the compartment will gradually rise to the level of the pressure in the container. In these embodiments there is eliminated the need to separately pressurize the compartments. In other disclosed embodiments of the invention, the second material stored within the compartment in the container includes a material responsive to the application of heat to generate a given pressure within the compartment.

In accordance with various embodiments of the invention, the compartment is divided into two chambers, in essence, a first chamber which is responsive to a rapid pressure change in the container to cause the release of the second material from a second chamber designed to separately hold the second material. In several instances, the first chamber has a small aperture provided in the exterior wall thereof which separates it from the container so that the first chamber will gradually reach the pressure present within the container. In accordance with another embodiment of the invention, the first chamber has an exterior wall separating it from the container, which is formed of a material permeable to the gas in the container so as to allow the interior of the first chamber to gradually reach the pressure prevalent within the container. In these embodiments the interior wall separating the first and second chambers is flexible to thereby allow the pressure reigning within the pressure responsive chamber to force the flexible interior wall against the material in the second chamber and cause the latter to be released or expelled through a frangible exterior wall in the second chamber. In one embodiment of the invention the flexible interior wall is a diaphragm, and in accordance with another embodiment of the invention it is a bellows. In these embodiments, an exterior wall of the second chamber forms the separable wall of the compartment. Furthermore, in accordance with one embodiment of the invention the separable wall is formed by a frangible wall while, pursuant to the teachings of another embodiment, it is formed by a separable cap.

Further, as contemplated for use in several disclosed embodiments of the invention, the first material is carbonated water and the second material comprises a flavoring therefor, such as a dipeptide sweetener.

Accordingly, it is a primary object of the present invention to provide a novel arrangement for a container for separately storing several materials prior to the opening of the container.

Another object of the present invention is to provide an arrangement of the type described having a pressure responsive compartment within the container and storing one of the materials, which automatically opens in response to a sudden change in pressure encountered in the container when the container is opened.

A more specific object of the present invention lies in the provision of an arrangement of the type described particularly adapted to contain a beverage and further to hold a powder material stored separated from the beverage by an impermeable barrier. The arrangement should also incorporate a convenience type opening generally employed in standard size beverage cans or bottles requiring only minor modification of standard closures or containers whereby any increase in container cost is minimal, and should be compatible with standard beverage filling and sealing equipment.

BRIEF DESCRIPTION OF THE DRAWINGS

The foregoing and other objects and advantages of the inventive pressure responsive arrangement consisting of a pressurized container providing for the separate storage of several materials and constructed pursuant to the teachings of the present invention may be more readily understood by one skilled in the art, having reference to the following detailed description of several preferred embodiments thereof, taken in conjunction with the accompanying drawings; wherein.

DETAILED DESCRIPTION OF THE DRAWINGS

Figure 2:
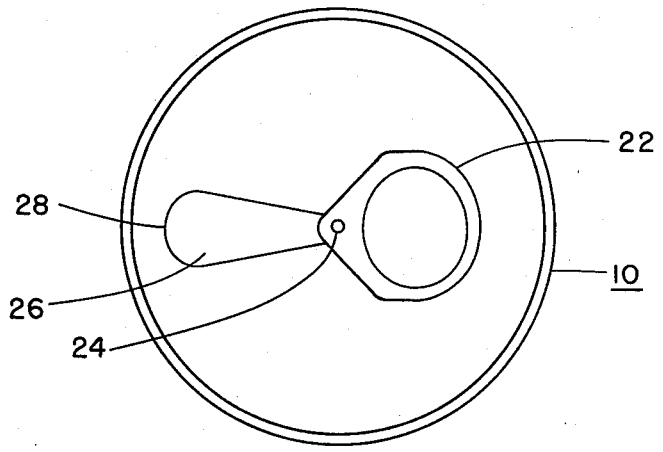
FIG. 2 is a top plan view of the container of FIG. 1.
Figure 1:
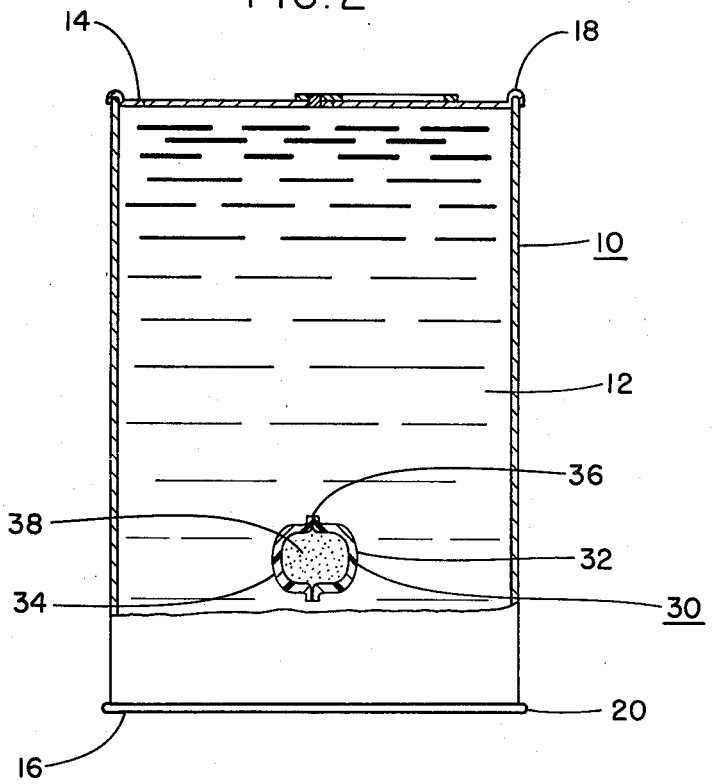
FIG. 1 is an elevational sectional view of a first embodiment of the invention illustrative of a pressurized liquid-filled container with a separable compartment containing a separately stored material immersed therein.

Referring now in detail to the drawings, FIG. 1 illustrates a cylindrical container in the form of a can 10 in which a first pressurized material 12, such as a carbonated drink, is stored therein. The container has relatively flat top and bottom closure members 14 and 16, which are crimped around their edges and soldered at 18 and 20 to sealingly fasten them to the cylindrical container wall. The top 14 has a pull-tab opener 22 attached thereto which is attached by means of a rivet-type fastener 24 to a weakened closure member section 26 which is weakened around its edges 28, such as through a stamped groove. The container and pull-tab suitably may be formed of a metal, such as aluminum or steel, however, the top closure member preferably is formed of a soft metal, such as aluminum, to allow the pull-tab opener to operate easily. The container has a separate compartment 30 therein which is formed of separable cup-shaped component halves 32 and 34. The halves are joined at a separable wall section 36, either by an encompassing water-soluble strip or adhesive material, and with the compartment being filled with a second material 38 which may be a powder or granular material, such as a flavoring for the carbonated drink for instance, a dipeptide sweetener. It is desirable to store the dipeptide separated from the carbonated water since the dipeptide tends to undergo a hydrolysis reaction after being mixed with the water so as to impart a limited shelf life to the mixture. The compartment may be formed of a suitable material such as metal but, preferably, is formed of plastic. The compartment has the same internal pressure as the container which, for a carbonated drink, is typically about five atmospheres.

Figure 3:
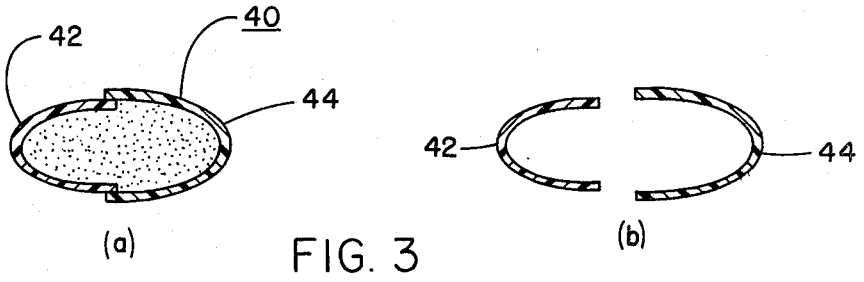
FIGS. 3*a* and 3*b*, 4*a* and 4*b*, and 5*a* and 5*b* are sectional views of different embodments of separable compartments shown, respectively, filled with a material and sealed and in an opened condition, which may be utilized in lieu of the compartment shown in FIG. 1.
Figure 4:
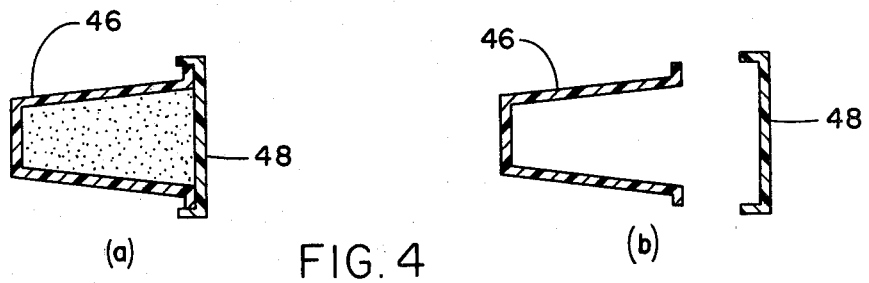
Figure 5:
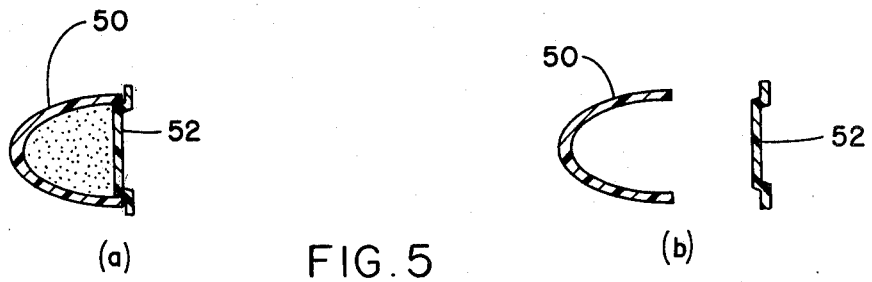

The arrangement provides for the automatic opening of the compartment 30 upon opening of the container 10 by means of the pull-tab opener 22. Upon opening of the can, a rapid pressure drop is produced therein whereas the pressure within the compartment 30 remains momentarily higher, in effect, at about five atmospheres . The greater pressure present within the compartment 30 forces it open along the separable wall section 36 and causes the release of its contents 38 into the container 10. Depending upon the weight of the compartment and the contents thereof, the compartment 30 may rest on the bottom of the container or may float therein. The compartment 30 may be formed in various shapes, and may take an elliptical capsule form 40 consisting of two interengageable semi-elliptical portions 42, 44, as shown in FIGS. 3*a* and 3*b*. Alternatively, it may take the form of a truncated conical cup 46 and flat closure 48 as illustrated in FIGS. 4*a* and 4*b*, or the form of a rounded or semi-elliptical cup 50 with a flat closure 52 as shown in FIGS. 5*a* and 5*b*. These shapes are merely illustrative of some of the many shapes the compartment may take and should not be construed as limitative thereof. Each of these compartments may be pressurized prior to being sealed within container 10, or may be pressurized later on as taught by some of the embodiments of the invention explained hereinafter.

Figure 7:
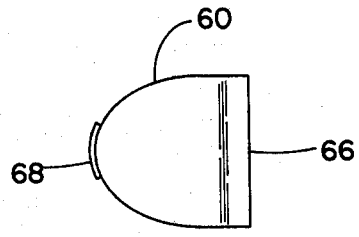
FIG. 7 is a top plan view of the compartment of FIG. 6.
Figure 6:
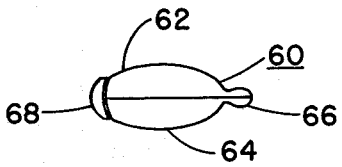
FIG. 6 is a side view of a clamshell type of compartment which may be used in the arrangement shown in FIG. 1.
Figure 8:
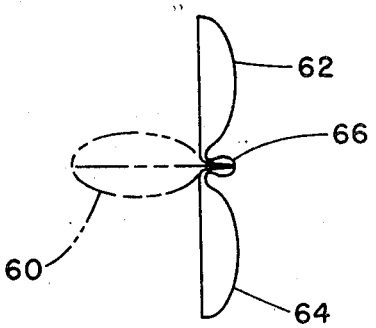
FIG. 8 is a side view of the compartment of FIGS. 6 and 7 in an opened condition.

FIGS. 6, 7 and 8 illustrate another embodiment of a compartment suitable for use in the container arrangement of FIG. 1. FIG. 7 is a top plan view of the compartment of FIG. 6, while FIG. 8 is a side view of the compartment in its opened condition. The compartment is formed of a clamshell-like receptacle 60 having a top portion 62 and a bottom portion 64 which are joined to each other along one edge by a hinge 66. The hinge 66 provides a spring action which normally biases the compartment 60 open in the absence of a closing force, such as a force provided by a pressure differential existing between the interior and exterior of the clamshell compartment, as explained below. The compartment may be formed of plastic or some other suitable material and, in particular, may be constituted of molded plastic. The compartment is filled with a second material, such as a powdered or granular flavoring, and the top and bottom portions 62, 64 are then closed and fastened together along their adjoining edges with cement, or some other suitable adhesive material 68. The adhesive material 68, which may be in the form of a strip or a cementitious adhesive, is applied to the joining edges of the clamshell receptacle halves, and is chosen to be soluble in the containerized liquid so as to allow for separation of the portions 62, 64. For instance, in the case wherein the first material is carbonated water, the adhesive might be a suitable water soluble glue, harmless when dissolved, many of which are commercially avaialble. The compartment is then placed within the container wherein the adhesive 68 is dissolved by the liquid leaving only the pressure differential between the interior of the container, which is typically at five atmospheres, and the interior of the compartment 60 to hold the compartment closed. In one embodiment of the invention, the compartment may be sealed in an atmospheric environment prior to being inserted in the container, and accordingly would have an internal pressure of one atmosphere. Upon opening of the container, the pressure differential disappears, thereby allowing the spring action of hinge 66 to open the clamshell compartment 60 and permit the release of its contents into the liquid stored in the container.

Figure 9:
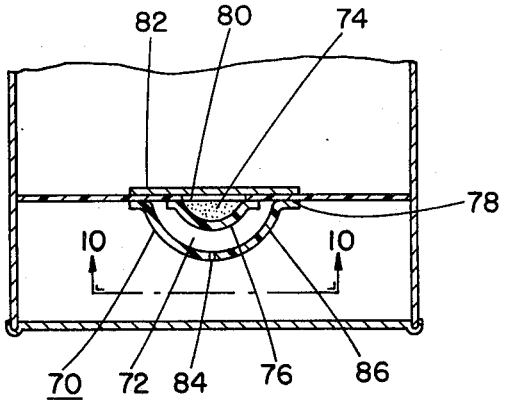
FIG. 9 illustrates a fragmentary elevational sectional view of another embodiment of the invention wherein a container adapted to be filled with a pressurized liquid has an igloo-shaped compartment for separately storing a material therein which has two separate chambers.
Figure 10:
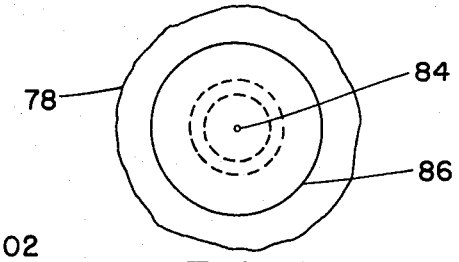
FIG. 10 is a bottom plan view of the igloo-shaped compartment as viewed along line 10—10 in FIG. 9.

FIGS. 9 and 10 illustrate an elevational sectional view of a portion of a container wherein the compartment 70 is formed in the shape of an inverted igloo. The igloo compartment has a first pressurization chamber 72 and a second material chamber 74, with the chambers being separated by a common flexible wall 76. The compartment is mounted on a disc-shaped base 78 which has a centrally formed aperture 80 therein. The common flexible wall 76 is shaped like a small igloo cantrally positioned within a larger igloo and forms an external surface for material chamber 74. A rupturable film 82 is applied to the top of base 78 and, because of the position of aperture 80, forms the top wall surface of material chamber 74. All of the components forming the igloo-type structure may be formed of suitable plastic materials. Alternatively, the rupturable wall 82 may be formed of a metallic foil, such as aluminum foil. In this embodiment, the compartment is supported in place in the container by having base 78 extend diametrically across the interior of the container into engagement with the inner cylindrical wall thereof. Base wall 78 may take any number of shapes, such as annular or strut-like, may be formed of metal or plastic, and may be glued or soldered to the inner cylindrical wall of the container. This embodiment operates as follows:

When the container is pressurized, aperture 84 in wall 86 allows the first chamber 72 to gradually assume the pressure within the container. Upon opening of the container, the internal pressure thereof rapidly drops to atmospheric, and aperture 84 in wall 86 is too small to allow the pressure in chamber 72 to adjust too rapidly to the lower pressure now present in the container. Accordingly, chamber 72 is momentarily at a much higher pressure than the surrounding container interior so as to cause flexible wall 76 to expand outwardly, pushing the second material in chamber 74 against the base 78 to cause it to rupture and to thereby allow the release of the second material into the contents of the container. Wall 86 must be sufficiently strong so that wall 82 ruptures rather than the former.

Figure 11:
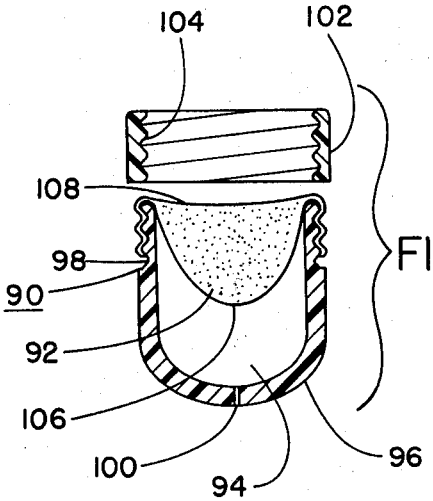
FIG. 11 is an exploded sectional view of another embodiment of a compartment which incorporates separate material and pressure responsive chambers.

FIG. 11 is an elevational sectional view of another embodiment of a compartment 90 which includes a separate material chamber 92 and a separate pressure responsive chamber 94. An elongated hemispherical housing 96 has external threads 98 formed at its upper circumference, and also has a small aperture 100 extending through its bottom communicating with pressure responsive chamber 94. An annular cap 102 has internal threads 104 engageable with the external threads 98 of housing 96. Both of these parts 96, 102 may be formed from many suitble materials, and are preferably constituted of molded plastic. A flexible membrane 106, such as a sheet of flexible rubber, extends so as to hang into the compartment, and the volume between membrane 106 and housing 96 defines the pressure responsive chamber 94. The second material is placed on top of or in the loop formed by the flexible membrane 106, and a rupturable membrane 108, such as a thin sheet of flexible platic, is placed over the second material. The volume between the flexible and rupturable membranes 106, 108 defines the material chamber 92. Both membranes are positioned with their outer edge portions extending over the external threads 98 of housing 96, and cap 102 is then screwed thereon to secure the compartment together while sealingly clamping the membrane edges between the threads 98, 104. In operation, the assembled compartment is placed within a container, with or without a retaining member similar to element 78 in FIG. 9 to secure it in place therein. Pressure responsive chamber 94 gradually assumes the pressure present within the container through aperture 100. Upon opening of the container, the pressure therein rapidly drops to atmospheric, momentarily leaving the pressure in chamber 94 much higher. The pressure differential forces flexible membrane 106 outwardly, pushing the second material against the membrane 108 and eventually forcing it to rupture, thereby resulting in the release of the second material into the contents of the container.

Figure 12:
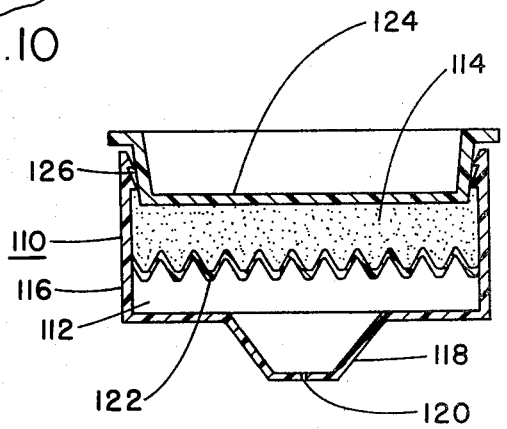
FIG. 12 illustrates another embodiment of a compartment including a material chamber and a pressure responsive chamber separated from each other by a diaphragm.

FIG. 12 illustrates another embodiment of the invention, showing a compartment 110 having a first pressure responsive chamber 112 and a second material chamber 114. The compartment has a generally cylindrical housing 116 with a small frustoconical depending portion 118 at its bottom in which there is provided a relatively small orifice 120. The orifice 120 extends from the container to the pressure responsive chamber 112, and allows the chamber to gradually assume the internal pressure of the container. Chamber 114 is adapted to hold a quantity of the second material therein, and is separated from chamber 112 by a flexible wall 122 which may be in the form of a diaphragm. Chamber 114 is sealed at its top by a liquid-tight cap 124 which is placed over the material in chamber 114 and is held snugly in place by the cylindrical side walls which may have gripping ridges 126 formed therein to help secure the cap in place. The housing and cap may be formed of molded plastic or some other suitable material, and diaphragm 122 may be formed of a sheet of flexible plastic or metal. Upon opening of the container, the momentarily greater pressure present within the pressure chamber 112 forces diaphragm 122 to expand in an upward direction, pushing cap 124 upwardly and forcing the release of the second material from the material chamber 114 into the container.

Figure 13:
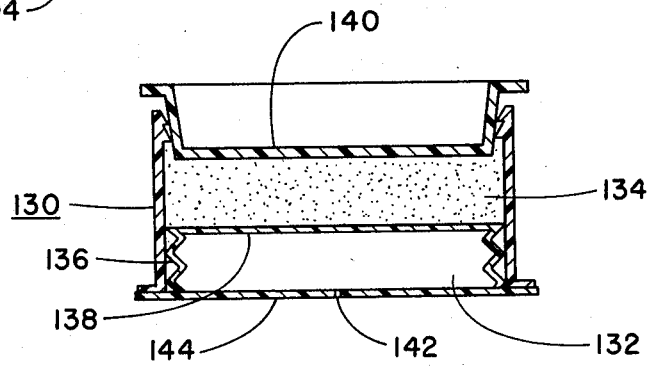
FIG. 13 illustrates another embodiment of a compartment similar to that shown in FIG. 12 but wherein the chambers are separated from each other by a bellows.

FIG. 13 illustrates yet another embodiment of a compartment 130 constructed according to the teachings of the present invention. The compartment has a pressure chamber 132 and a material-containing chamber 134, with the chambers being separated from each other by a bellows 136 having a flat top surface 138. Bellows 136 may be formed of a suitable flexible metal or plastic material. Material chamber 134 has its top closed by a liquid-tight cap 140 similar in construction and function to that shown in FIG. 11. Pressurized chamber 132 has an orifice 142 formed in its bottom exterior wall 144 which allows it to gradually assume the pressure present in the encompassing container. Upon opening of the container, the momentarily greater pressure present within the pressurized chamber 132 forces the top surface 138 of the bellows 136 upwardly, causing cap 140 to be disengaged and forcing the release of the material stored in chamber 134 into the contents of the container.

In other embodiments of the invention, the pressure chambers 72, 94, 112 and 132 may each be formed with an external wall which is permeable to the pressurizing gas in the container. The permeable wall will permit the pressure chamber to gradually reach the pressure of the surrounding container after being sealed therein, and eliminates the need for a small aperture through an exterior wall of the pressure chamber.

Figure 15:
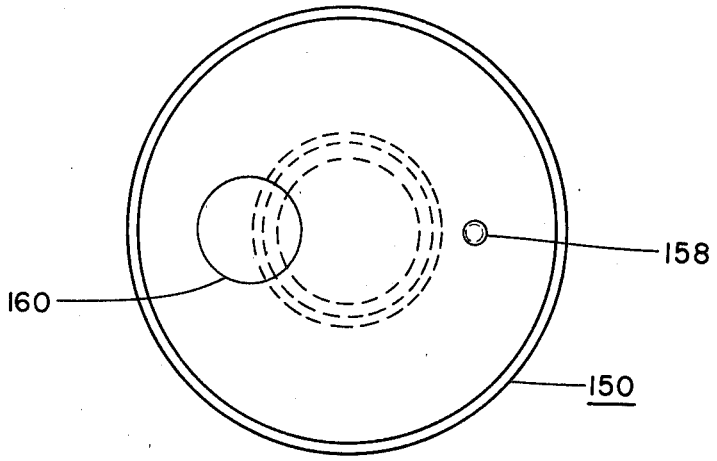
FIG. 15 is a top plan view of the container of FIG. 14.
Figure 14:
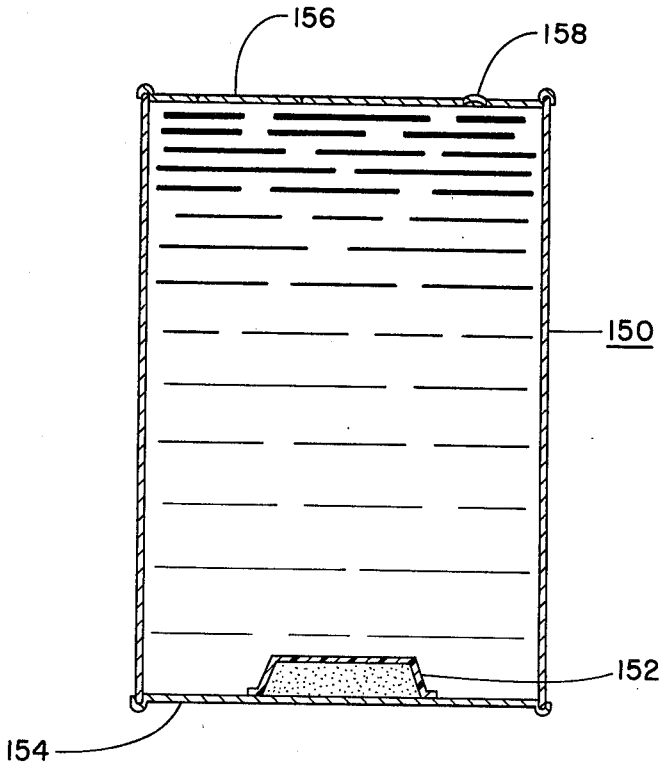
FIG. 14 is an elevational sectional view of another embodiment of the invention wherein a separate compartment in the container contains a material which is responsive to the application of heat to pressurize the compartment.

FIGS. 14 and 15 illustrate, respectively, elevational sectional and top plan views of a liquid-filled can-like container 150 having a compartment 152 therein for the separate storage of a second material. The compartment 152 is releasably attached, as by a suitable adhesive, to the inner surface of bottom closure 154 of the container. The second material in the compartment includes a material responsive to the application of some external factor, such as the application of heat, to generate a given pressure within the compartment. In this embodiment, the container is sealed with the compartment located therein, and the sealed container is subjected to the application of heat for a given period of time. This embodiment of the invention may find particular utility with products which must be pasteurized after packaging, as is common with various types of edible products, and also with soft and hard drinks. The top closure 156 of container 150 is provided with a normally closed pressure vent aperture 158, which is simply a small circular section in the top closure weakened around its circumference, such as by a stamped groove. The pressure release vent hole is smaller in area than a similarly formed main dispensing orifice 160, and is therefore easier to initially push into the container in opposition to the internal pressure therein. After the pressure vent aperture 158 has been pressed open, the larger main access aperture 160 may be opened fairly easily as the internal pressure of the container no longer impedes its opening. When vent 158 is opened, the pressure within the can drops rapidly to atmospheric, and the greater pressure present within compartment 152 forces it away from the bottom 154 of the container, thereby releasing the contents of the compartment into the container. The top and side walls of the compartment 152 may be suitably constructed from plastic or metal, while the bottom wall thereof is constituted of the bottom of the container. The container may be constructed of steel, aluminum, or some other suitable material, but its top is preferably formed of a soft material, such as aluminum, to allow for the ready opening of aperture 158 and orifice 160.

Figure 17:
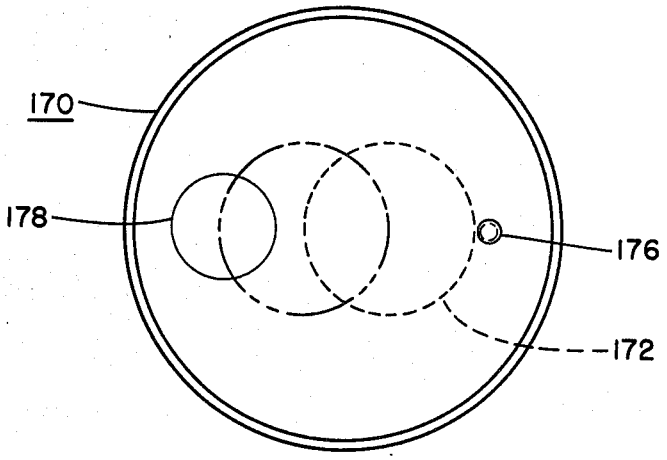
FIG. 17 is a top plan view of the container of FIG. 16.
Figure 16:
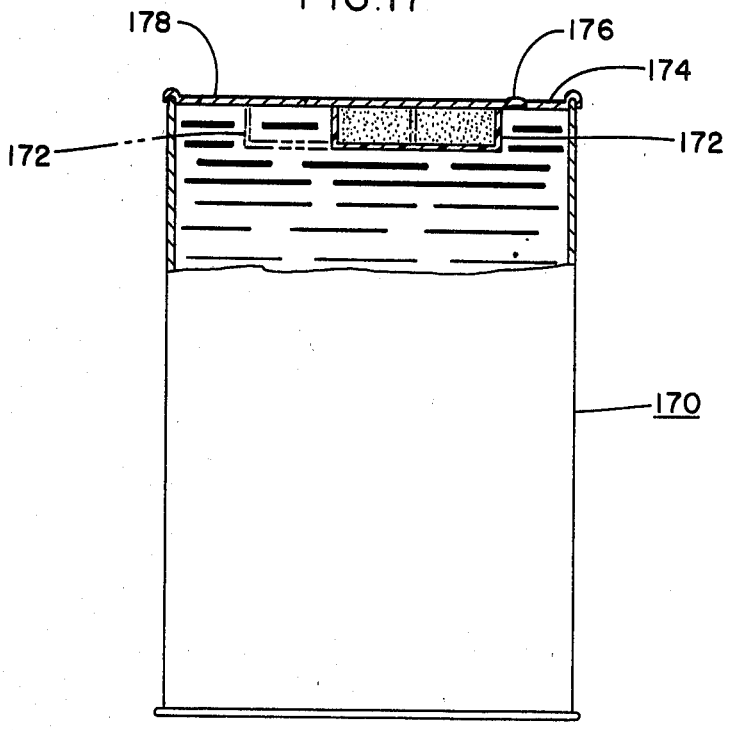
FIG. 16 is a partly sectioned elevational view of another embodiment of this invention wherein the compartment is fastened beneath the top closure surface of a container.

FIGS. 16 and 17 illustrate, respectively, elevational sectional and top plan views of another embodiment of a container 170 wherein a pressure responsive compartment 172 is located beneath the top closure 174 of a container. The compartment 172 is releasably attached to the inner top surface of the container, as by some suitable adhesive, and may be internally pressurized in a manner as taught by any of the previously described embodiments. The top closure wall includes a small vent aperture 176 and a larger dispensing orifice 178, both of which are formed by weakening the top closure wall in sections thereof, as by stamping. Opening of the vent aperture 176 lowers the pressure in the container to atmospheric and causes the presently higher pressure in compartment 172 to forcibly detach the compartment from engagement with the top closure wall 174 so as to release its contents into the container. As shown by phantom lines in one variation of this embodiment the compartment 172 may be positioned so as to extend beneath the dispensing orifice 178, which further ensures that the compartment is detached from the top surface when the orifice 178 is pressed into the container.

While several embodiments of pressurized containers have been disclosed providing for the segregated storage of several materials, the teachings of the present invention will suggest many alternative embodiments to those skilled in the art. For instance, the disclosed embodiments of the invention provide for the separate storage of only two materials. However, it is readily apparent that other embodiments of the invention may separately store three or more materials prior to the opening of the container. Additionally, in the disclosed embodiments of the invention, the ambient pressure is atmospheric pressure and the superambient pressure in the container is approximately five atmospheres, however, in other modifications of the invention, the superambient pressure, which generally depends upon the nature of the first material, may be different. In some environments, the ambient pressure may also be other than atmospheric. Furthermore, in some embodiments of the invention, the interior of the container may be at a subatmospheric pressure, and the compartment may be made responsive to a pressure increase upon opening of the container, as by a pressure responsive latch, to automatically cause the release of the second material into the contents of the container.

What is claimed is:

1. A container arrangement for separately storing a first liquid material and a second material in a container and providing for the automatic admixing of the first and second materials upon opening of the container, comprising, a container containing said first liquid material at superatmospheric pressure, with the pressure surrounding said container being atmospheric, a separate closed compartment arranged within said container and filled with said second material, said separate compartment being formed of a unitary piece of plastic molded as a clamshell shaped compartment with a first half of the unitary piece forming a first separable component of the compartment and a second half of the unitary piece forming a second separable component of the compartment, said first and second halves being hingedly joined along a common linear hinge wall which provides an opening force to bias the first and second halves apart toward an open position of the clamshell compartment, said second material being placed in the clamshell compartment at atmospheric pressure and the clamshell compartment then being closed against the opening force of the common linear hinge wall, and the clamshell compartment then being retained in a closed position by an adhesive material adhesively joining the separable halves of said clamshell compartment, said adhesive material being soluble in the first liquid material stored in said container, said clamshell compartment being placed, after being filled with said second material and then being adhesively joined, in the first liquid material in the container and the container then being sealed and attaining said superatmospheric pressure, after which said adhesive is dissolved by said first liquid material, leaving only the pressure differential between the superatmospheric pressure inside said container and the atmospheric pressure inside of said clamshell compartment to provide a closing force to hold the separable halves closed together in a compartment-sealing condition with the closing force provided by said pressure differential being greater than the opposed, opening force provided by said common linear hinge wall such that when the pressure differential between the compartment and container is removed, responsive to opening of said container, the compartment will be biased apart by the opening force provided by said linear hinge wall to empty the second material from said compartment into first liquid material in said container.

2. An arrangement as claimed in claim 1, said compartment being completely unattached to and separate from said container.

3. An arrangement as claimed in claim 1 or 2, said container being a can, said first material being a carbonated beverage contained in the container at a superatmospheric pressure of approximately five atmospheres.

* * * * *